United States Patent [19]

Ratner, deceased et al.

[11] Patent Number: 4,741,244

[45] Date of Patent: May 3, 1988

[54] ELEMENTS FOR AN ADD-ON REACTIVE ARMOUR FOR LAND VEHICLES

[75] Inventors: Eugene Ratner, deceased, late of Galil; by Ruth Eshel, heir; by Michal Yuzis, heir, both of Haifa; by Dan Ratner, heir, Galil; Joab Erlich, Moshav Yuvalim, all of Israel

[73] Assignee: The State of Israel, Ministry of Defence, Rafael Armament Development Authority, Israel

[21] Appl. No.: 20,210

[22] Filed: Feb. 27, 1987

Related U.S. Application Data

[63] Continuation of Ser. No. 699,256, Feb. 7, 1985, abandoned.

[30] Foreign Application Priority Data

Feb. 9, 1984 [IL] Israel ..... 70914

[51] Int. Cl.[4] ..... F41H 5/04

[52] U.S. Cl. ..... 89/36.17; 109/36; 109/81; 109/84

[58] Field of Search ..... 89/36.02, 36.08, 37.17; 109/36, 37, 49.5, 78, 80, 81, 82, 84; 428/911

[56] References Cited

U.S. PATENT DOCUMENTS

| | | | |
|---|---|---|---|
| 2,382,862 | 8/1945 | Davis | 89/36.08 |
| 4,036,104 | 7/1977 | Pagano et al. | 89/36.08 |
| 4,368,660 | 1/1983 | Held | 89/36.17 |
| 4,398,446 | 8/1983 | Pagano et al. | 89/36.08 |

FOREIGN PATENT DOCUMENTS

| | | | |
|---|---|---|---|
| 2031658 | 5/1972 | Fed. Rep. of Germany . | |
| 2636595 | 2/1978 | Fed. Rep. of Germany | 89/36.17 |
| 2380528 | 9/1978 | France | 89/36.17 |
| 1581125 | 12/1980 | United Kingdom . | |

*Primary Examiner*—Stephen C. Bentley
*Attorney, Agent, or Firm*—Steinberg & Raskin

[57] ABSTRACT

Protection of land vehicles such as tanks, armoured cars or the like against shaped charge projectiles. Protection is achieved by a cover member having suspended therefrom on the side that faces the substrate at least one explosive insert comprising an explosive layer sandwiched between two metal layers, such that when the element is mounted on the substrate the explosive insert remains distanced therefrom.

4 Claims, 7 Drawing Sheets

ELEMENTS FOR AN ADD-ON REACTIVE ARMOUR FOR LAND VEHICLES

This application is a continuation of Ser. No. 699,256, Feb. 7, 1985 now abandoned.

BACKGROUND OF THE INVENTION

The present invention concerns protective elements for making an add-on reactive armour mounted on the outside of a land vehicle liable to be exposed to attack by projectiles with shaped charge munition, e.g. a tank, an armoured car and the like.

Projectiles with shaped charge munition, also known as hollow charge munition, are known to pierce armour and thereby destroy the protected object from within. This capacity of a shaped charge results from the fact that upon detonation there forms an energy-rich jet also known as "thorn" or "spike" which advances at a very high speed of several thousand meters per second and is thereby capable of piercing even relatively thick steel walls, such as are used in armoured vehicles and tanks.

In U.S. Pat. No. 4,368,660 there is described an arrangement which purports to afford protection against the penetrating effect of an exploding hollow charge. According to that proposal there is provided a continuous wall structure having an explosive layer sandwiched between two wall members of an inert material, e.g. a metal, and being so arranged that the axis of an impinging projectile and of the thorn formed upon detonation, includes with the surface of the wall structure an acute angle of say 45°. According to said U.S. patent, when a hollow charge projectile hits the upper surface of such a protective arrangement and the explosive layer detonates, the walls thereof are thrown in opposite directions, one moving away from and the other one in the direction of the protected substrate. In consequence and due to the angle included betwen the thorn and the wall surface, the thorn is successively intersected by different portions of the wall members with the consequence that the energy of the thorn is rapidly consumed.

A similar arrangement is disclosed in British patent specification No. 1,581,125 with the sole difference that in accordance with that disclosure the arrangement of the layer of explosive substance may optionally be covered only on one side by a layer of a non-combustible material.

The theory put forward in both the said U.S. and British patent specifications is basically sound but in practice it has been found that arrangements disclosed therein are inoperable.

For one, it follows from the disclosure in the specifications of these patents that the protective arrangement is mounted directly on the substrate to be protected. In consequence the rear wall of the arrangement, i.e. the one that bears on the substrate, is virtually immobile and cannot move anymore towards the substrate. Consequently the rear wall is prevented from participating in the reduction of the energy of the thorn. Furthermore, where the protective arrangement is continuous as stipulated in the claims of U.S. Pat. No. 4,368,660, there occurs a so-called sympathetic initiation, meaning that where the explosive charge is detonated at the site that is hit by a hollow charge projectile, this detonation spreads in all directions with the consequence that the entire protective arrangement or a significant part thereof is destroyed by one single hit. An arrangement with such properties is obviously of no practical value because in combat an armoured vehicle or tank must be capable to absorb severeal hits and accordingly the arrangement should be such that upon each hit only a restricted area around the hit site is destroyed while the remaining protective arrangement remains intact. A similar sympathetic initiation also results where the protective arrangement is applied to the walls of a vehicle in the manner of roofing tiles as mentioned in column 3 lines 48 and 49 of the U.S. Pat. No. 4,368,660 it is inherent in a roofing tile arrangement that the individual members overlap.

SUMMARY OF THE INVENTION

It is the object of the present invention to provide an improved add-on reactive armour for land vehicles such as tanks, armoured personnel carriers and the like, free of the above shortcomings and capable of affording protection against shaped charge warheads.

The invention is based on the experimental finding that for producing the desired effect theoretically described in U.S. Pat. No. 4,368,680 and British patent specification No. 1,581,125, the contribution of the rear wall of the explosive assembly is of even greater significance than that of the front wall, provided it has a freedom of movement.

Accordingly, in accordance with the present invention there is provided an element of an add-on reactive armour for protecting a substrate against shaped charge warheads, comprising a cover member having suspended therefrom on the side that faces the substrate at least one explosive insert comprising an explosive layer sandwiched between two metal layers such that when the element is mounted on a substsrate the explosive insert remains distanced therefrom.

In accordance with one embodiment of the invention the cover member is mounted directly on the substrate.

In accordance with another embodiment of the invention the element comprises a cover member and a base member and said explosive insert is suspended inside the element from the cover member so as to remain clear of the base member.

Preferably an element according to the invention is so designed that the explosive insert(s) is/are shielded from the surroundings in order to avoid that a shock wave emanating from one detonating element should affect neighbouring ones. To this end the cover member and/or the base member are suitably skirted.

The explosive layer may be of any suitable explosive material such as, for example, octogen, nitropenta, TNT, various hexogen compositions such as "Composition A" (hexogen+wax), "Composition B" (hexogen+TNT+wax), "Composition C" (hexogen+fats) and many more. All these and other explosive compositions applicable in accordance with the invention are known and commercially available and there is thus no need for a detailed dscription thereof.

The technique by which the explosive composition is incorporated in the insert depends on the nature and consistency of the composition and any conventional technique such as pressing, casting, stuffing and spreading is applicable.

For making a reactive armour from individual elements according to the invention, the elements are mounted on the substrate in juxtaposition in such a way that on the one hand no substantial areas are left uncovered while, on the other hand there is no overlap between individual elements in order to avoid any sympathetic initiation.

The attachment of the elements according to the invention to the wall to be protected can be effected in any suitable way such as screwing, welding, bolting and the like. In a preferred mode of mounting a plurality of threaded bolts or studs are welded in accordance with a predesigned layout to all those sections of the substrate to be protected, e.g. the hull and turret of a tank, and each element comprises holes and/or cut-outs by means of which it is engaged by bolts, and the so mounted elements are tightened with suitable tightening means such as nuts. Where an element according to the invention comprises both a cover member and a base member, each member may be provided with lugs having registering holes for mounting on said bolts. Alternatively, the cover and base members may be mounted on different bolts. By yet another alternative the design of the element may be such that only the cover is mounted on bolts and the base member is retained in consequence of the tightening of the cover.

Each element is so mounted on the substrate that the outer face of the element is oblique with respect to the expected trajectory of an oncoming projectile. In some cases this results from the very shape of the substrate, e.g. of parts of the hull and turret of a tank, while in other cases the element has to be suitably shaped to form the desired obliquity. Yet another mode of achieving the desired obliquity of the explosive insert with respect to the expected trajectory of an oncoming projectile, is to mount the insert in an askew manner inside the element such that the insert and the cover member are not parallel to each other.

Element according to the invention comprising a base member may, if desired, be mounted clear of the substrate. To this end it is possible, for example, to fit the substrate with studs serving as spacers and having each an upper, threaded portion of smaller diameter. When this mode of mounting is resorted to it is possible to mount an element on studs of different height and in this way achieve the desired obliquity of the explosive insert.

The invention also comprises land vehicles fitted with an add-on armour made of elements as specified above.

BRIEF DESCRIPTION OF THE DRAWINGS

The invention is illustrated, by way of example only, in the accompanying drawings in which.

DESCRIPTION OF THE PREFERRED EMBODIMENTS

Figure 1:
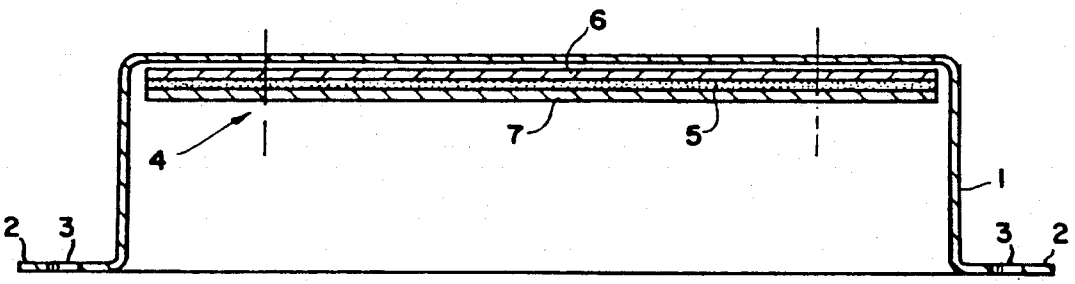
FIG. 1 is a section through one embodiment of the invention.

The element illustrated in FIG. 1 is of the kind in which the cover is mounted directly on the surface of a vehicle to be fitted with an add-on reactive armour in accordance with the invention. It comprises a skirted cover 1 having lugs 2 with holes 3 for receiving screw threaded bolts (not shown) which after mounting are locked and tightened by means of nuts, screw threaded caps, or the like tightening members.

Suspended from the inner face of cover 1 is an explosive insert 4 comprising an explosive layer 5 sandwiched between two metal plates 6 and 7. The illustration of the explosive insert 4 is diagrammatic only but it should be noted that the edges of plates 6 and 7 preferably cooperate all around in such a way that shock waves resulting from the detonation of the explosive layer do not spread laterally.

In order to produce an add-on reactive armour out of elements of the kind shown in FIG. 1, each such element is mounted by means of holes 3 on screw threaded bolts integral with the substrate and is then tightened by means of tightening elements such as nuts, screw-threaded caps and the like.

When an element of the kind shown in FIG. 1 is mounted on a vehicle as a component of an add-on reactive armour in the manner specified, the explosive insert 4 remains clear of the surface of the vehicle. There also exists a clearance between the explosive insert and the cover 1 and the significance of these clearances for the proper functioning of the device according to the invention will be described further below.

In the embodiment of FIG. 1 the explosive element 4 is shown to be parallel to the upper, horizontal portion of cover 1. However, depending on the desired requirements the insert 4 may also be mounted askew with respect to cover 1.

Figure 2:
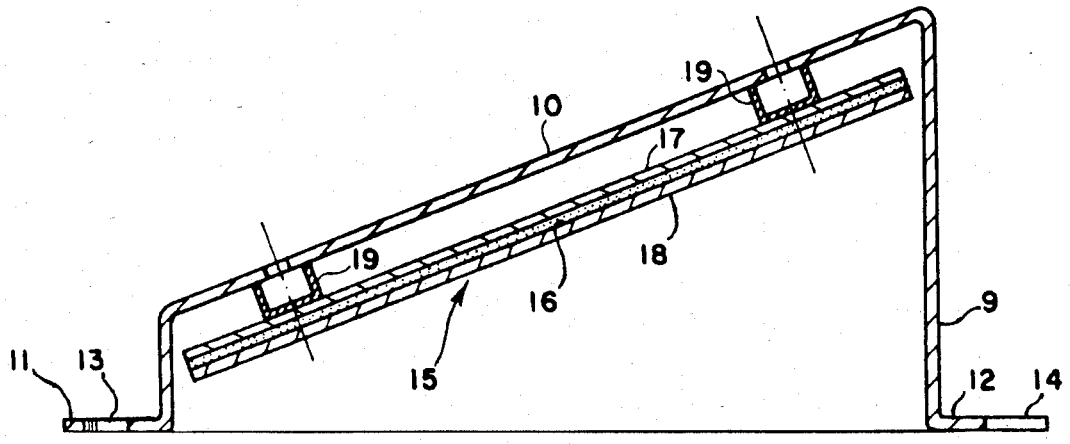
FIG. 2 is a section through another embodiment of the invention.

The embodiment of the invention shown in FIG. 2 comprises a skirted cover 9 whose top portion 10 is slanted and which comprises lugs 11 and 12 having, respectively, a hole 13 and a cut-out 14. An explosive insert 15 is suspended from top portion 10 of cover 9 with the interposition of spcer ribs 19.

Figure 3:
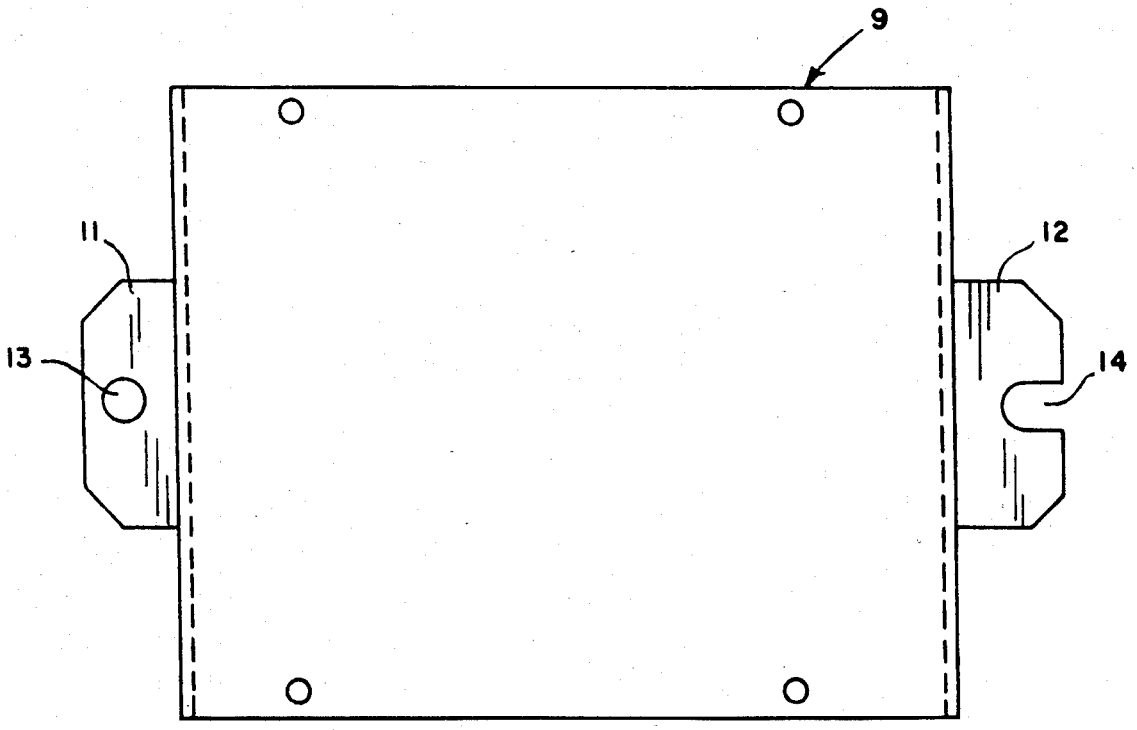
FIG. 3 is a plan view of the embodiment of FIG. 2.

The embodiment of FIGS. 2 and 3, similar as that of FIG. 1 does not comprise a base member and the cover member 9 is mounted directly on the surface of the vehicle to be protected with the aid of lugs 11 and 12 whose hole 13 and cut-out 14, respectively, cooperate with bolts suitably fitted onto the surface of the vehicle.

As is clearly seen from FIGS. 2 and 3 the explosive element 15 is clear of both the top portion 10 of cover member 9 and the surface of the vehicle to be protected.

Figure 4:
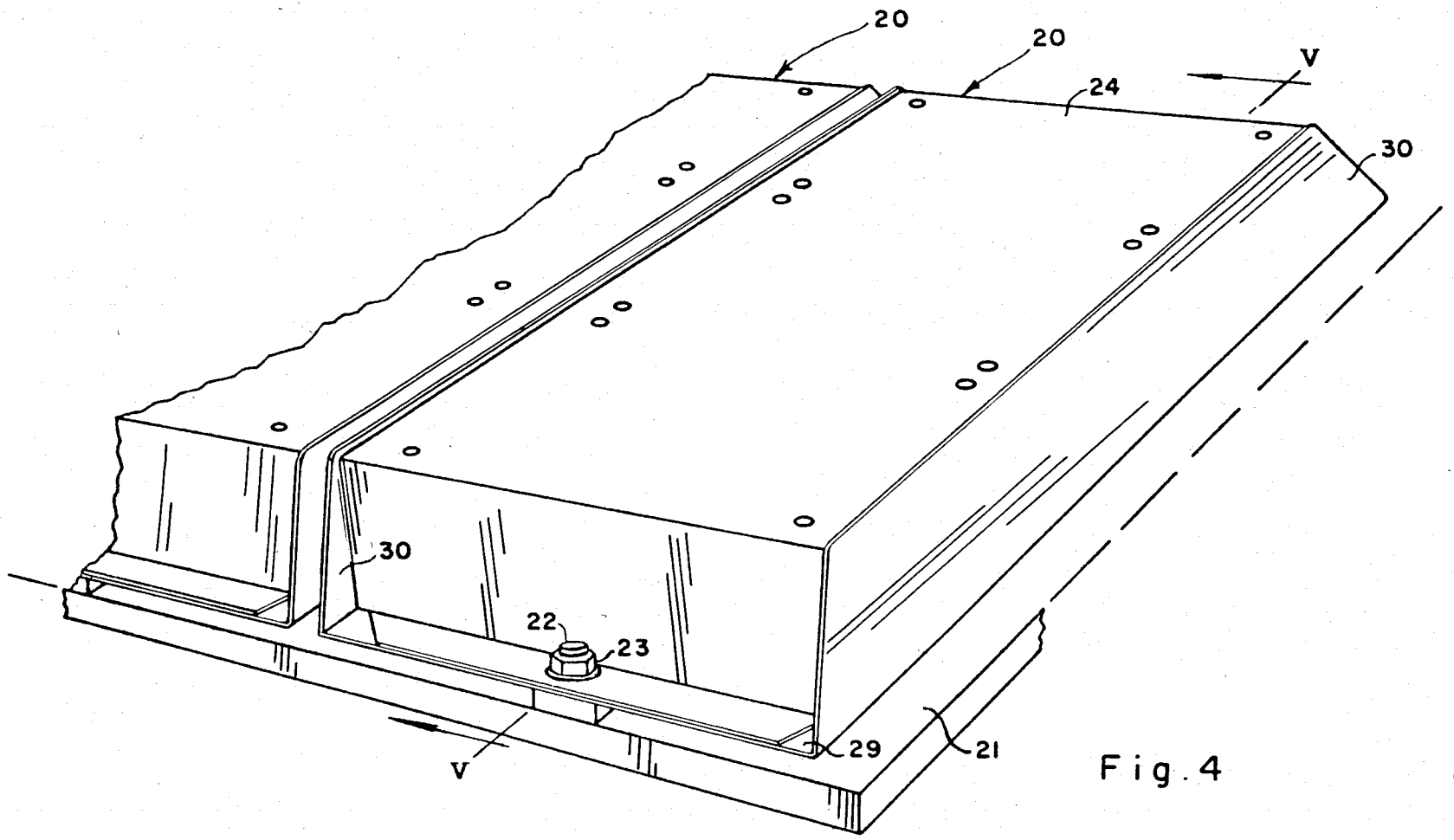
FIG. 4 is a perspective view of yet another embodiment of the invention.
Figure 5:
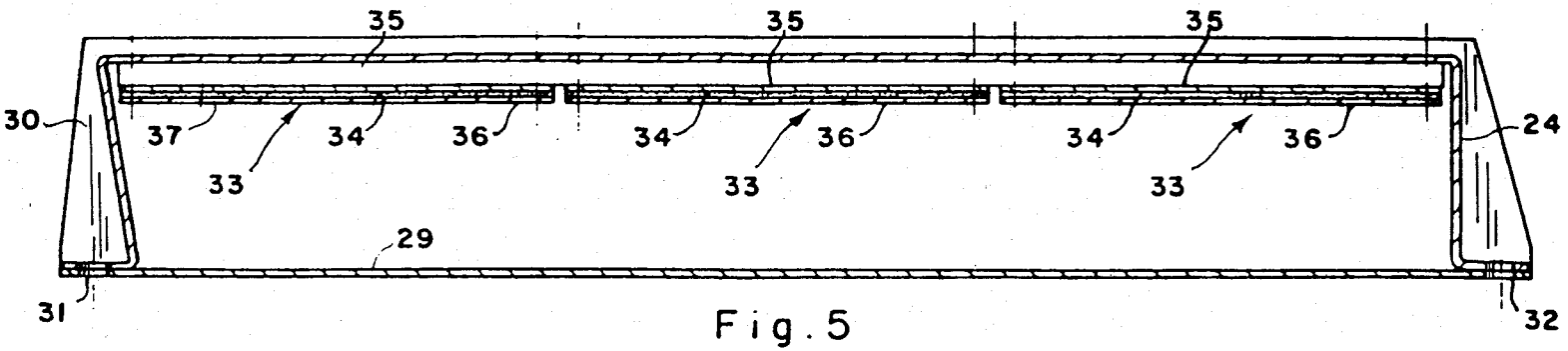
FIG. 5 is a longitudinal section along line V—V of FIG. 4.
Figure 6:
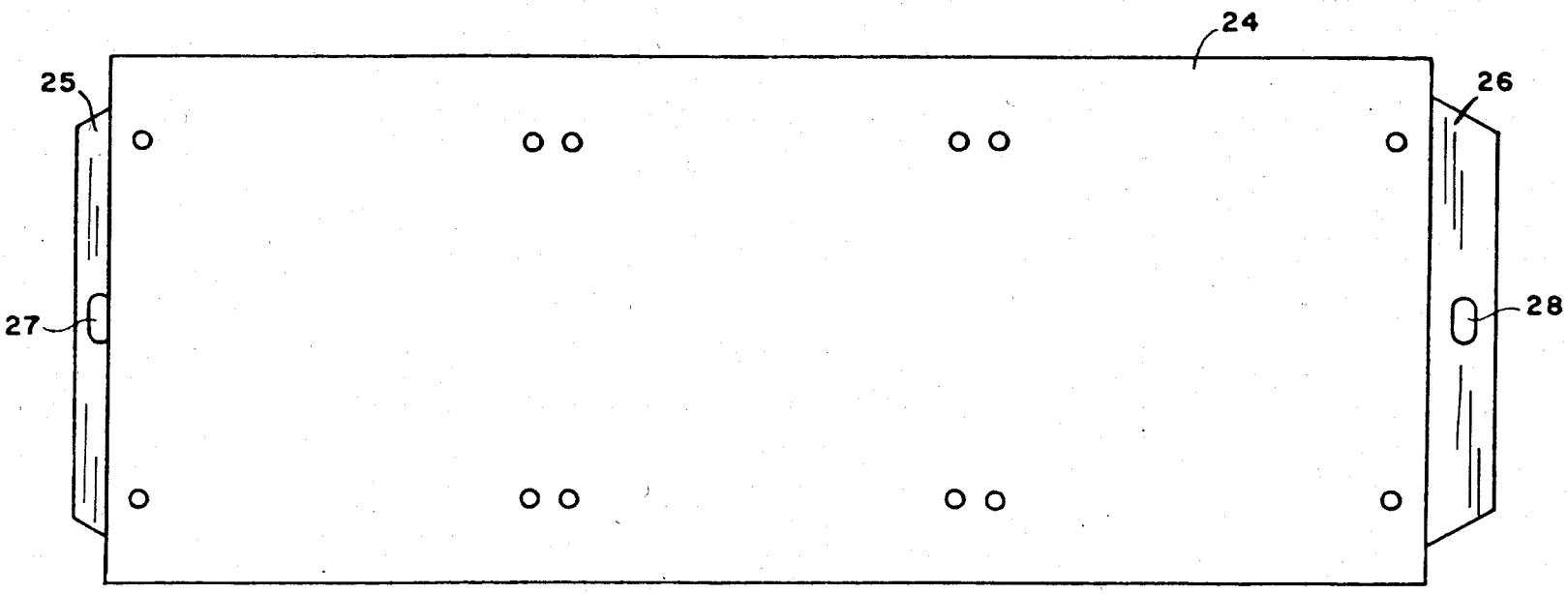
FIG. 6 is a plan view of the embodiment of FIGS. 4 and 5.

The embodiment of an element according to the invention shown in FIGS. 4–6 comprises both a cover and a base member. FIG. 4 also shows how such elements are mounted and as seen, a plurality of elements 20 (only two of which are shown in FIG. 4) are mounted on an outer wall 21 of a vehicle to be protected, e.g. a tank, by means of studs 22 integral with wall 21 and having an upper, threaded portion of reduced diameter fitted to cooperate with suitably shaped holes in element 10, and tightening members such as nuts 23.

The element 20 shown in FIGS. 4–6 comprises a laterally skirted cover member 24 fitted with lugs 25 and 26 having oval shaped holes 27 and 28, respectively.

The element further comprises a longitudinally skirted base member 29 having upright side walls 30 which extend to slightly above the top portion of cover 24. Base member 29 comprises holes 31 and 32 which in the assembled state of the element are in register with, respectively, holes 27 and 28 of the cover member 24.

Three identical explosive inserts 33 comprising each an explosive layer 34 sandwiched between metal plates 35 and 36 are suspended from the horizontal top portion of cover member 24 with the interposition of spacer ribs 37 (only one of which is seen in FIG. 5). It should be noted here once more that the illustration of the inserts 33 is diagrammatic only and that in actual practice the edges of metal plates 35 and 36 cooperate all around in such a way that upon detonation of one insert the shock waves are prevented from spreading laterally whereby sympathetic initiation is avoided.

As is seen from FIGS. 4 and 5, in the mounted state the explosive inserts 33 are clear of both the top and bottom of the element, the distance from the bottom being larger than from the top.

Figure 7:
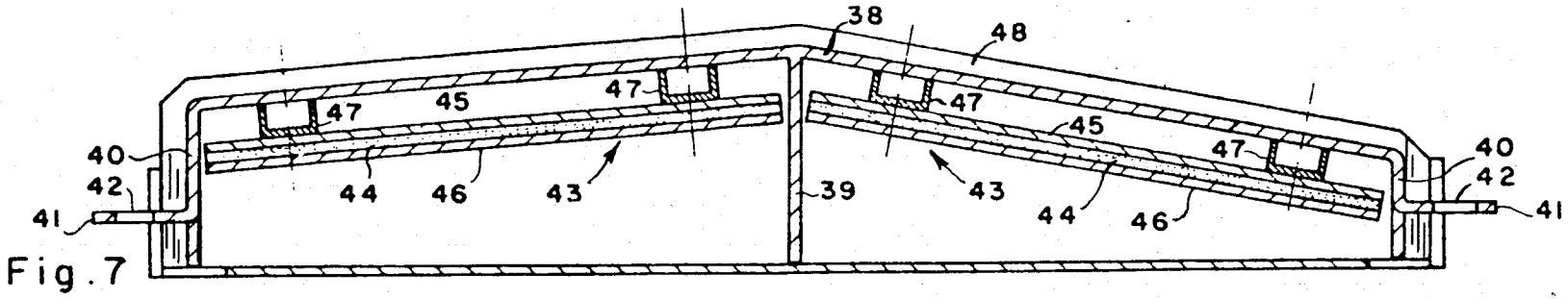
FIG. 7 is a longitudinal section of yet another embodiment of the invention.
Figure 8:
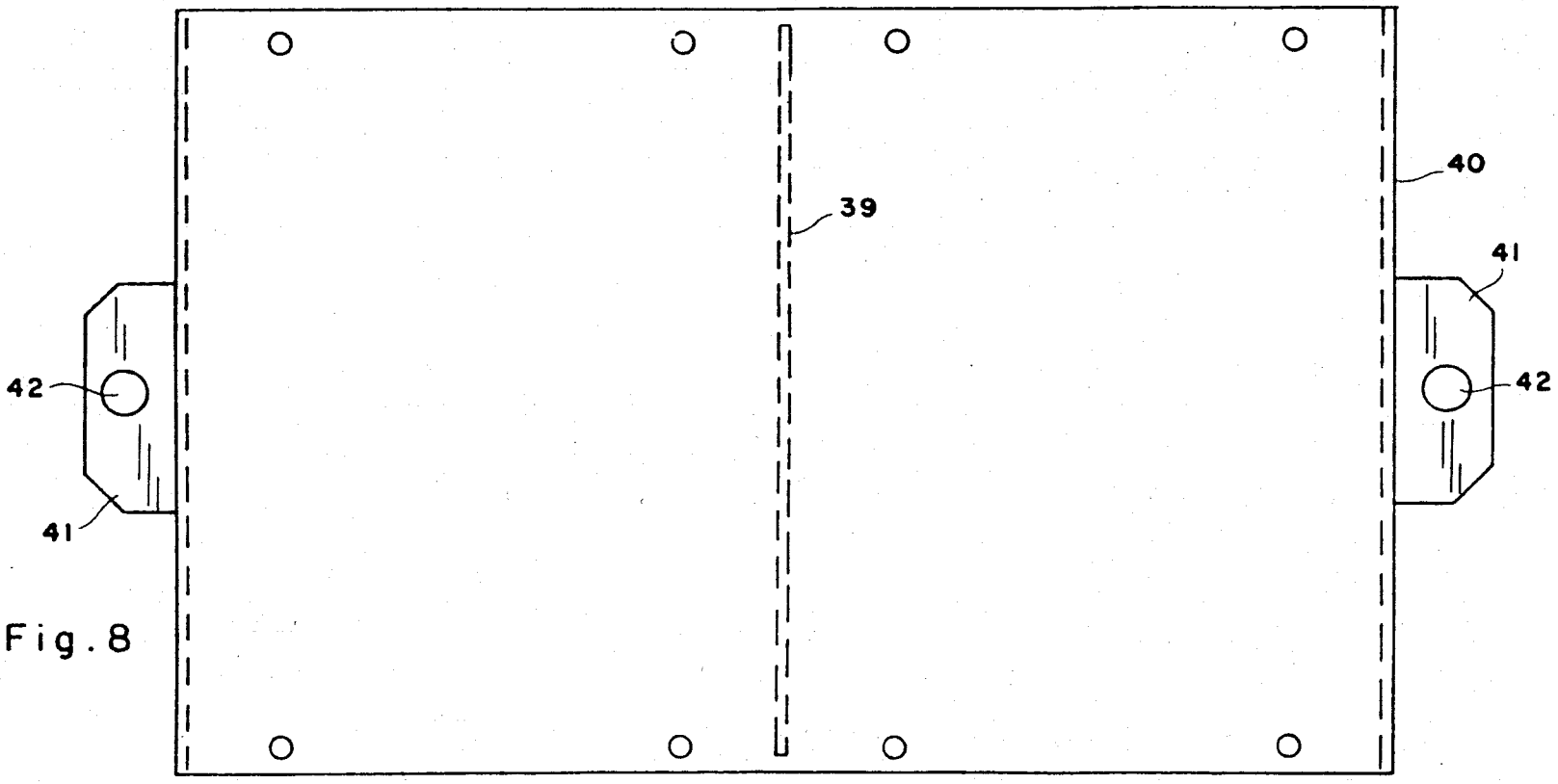
FIG. 8 is a plan view of the cover member of the embodiment of FIG. 7.
Figure 9:
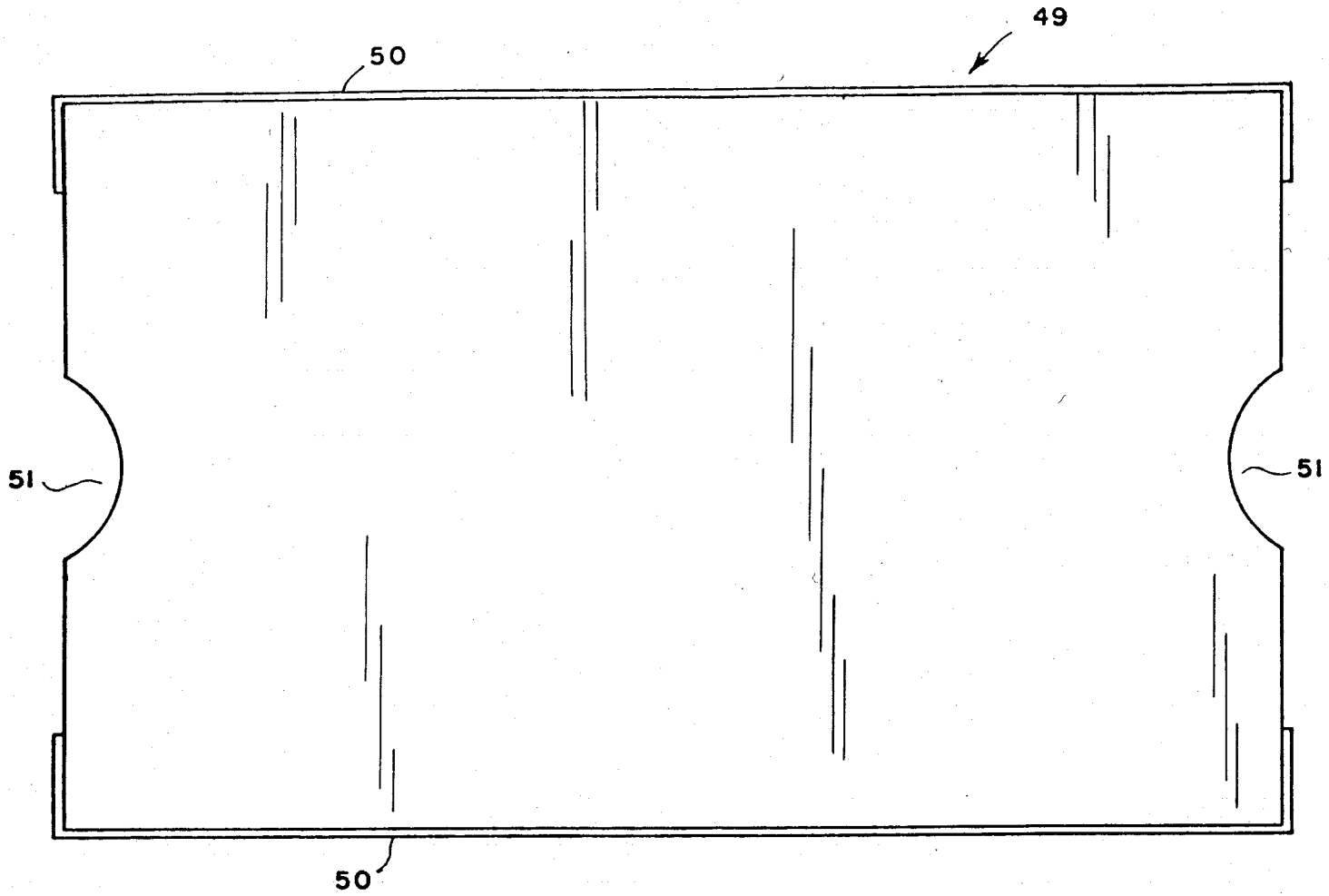
FIG. 9 is a plan view of the base member of the embodiment of FIG. 7.

The embodiment of a modular element according to the invention shown in FIGS. 7 to 9 is also of the type which comprises both a cover and a base member. As shown, the element comprises a double slanted, roof-shaped cover 38 comprising a depending partition 39, depending side walls 40 and lugs 41 fitted with holes 42.

Two explosive inserts 43 comprising each an explosive layer 44 sandwiched between two metal plates 45 and 46 are suspended from the top of cover 33 with the interposition of spacer ribs 47.

Partition 39 divides the interior of the element into two compartments whereby any sympathetic initiation between the inserts 43 on both sides of the partition is avoided.

Cover 38 further comprises an outer protective layer 48.

The element of FIGS. 7 to 9 further comprises a base member 49 having upright side walls 50 and a pair of cut-outs 51 which in the mounted state serve to arrest the element between a pair of studs.

Here again the explosive elements 43 are distanced from both the top and bottom of the element.

Figure 10:
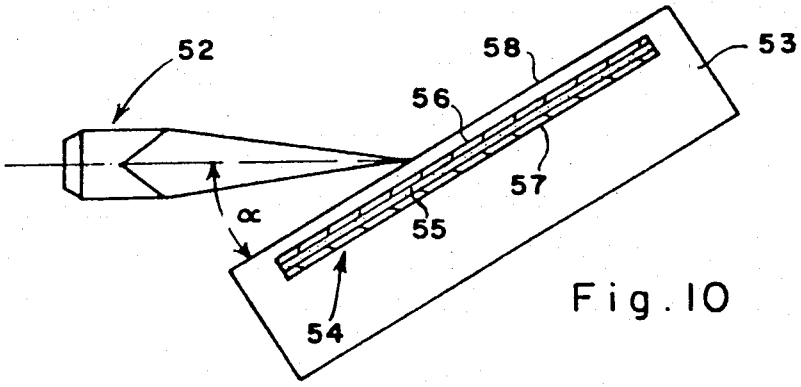
FIG. 10 is a diagrammatic illustration showing the moment of impact of a hollow charge projectile on an element according to the invention.

FIG. 10 shows in a diagrammatic manner the impact of a projectile 52 onto a protective element 53 according to the invention. The element is shown in a diagrammatic manner without any demarcation between the cover and base members and is also shown to comprise an explosive insert 54 comprising an explosive layer 55 sandwiched between metal plates 56 and 57. As shown the central axis of the impinging projectile 52 includes with the surface 58 of element 53 an acute angle $\alpha$ which is shown here to be of the order of approximately 35° but may also be smaller such as 30°.

Upon the impact of the projectile 52 on surface 58 the shaped charge of the projectile is caused to detonate and there forms a highly energetic thorn or spike which penetrates the top wall 58 of element 53 and also the top wall 56 of explosive insert 54. The thorn or spike progresses at a speed of between 2000 and 12,000 m/sec and upon its impact on the explosive layer 55 the latter is caused to detonate, the detonation speed being, for example, about 500 to 2000 meters per second. In consequence of this detonation the two metal plates 56 and 57 are driven away from layer 55, plate 56 away from the protected substrate and plate 57 towards the substrate.

Figure 11:
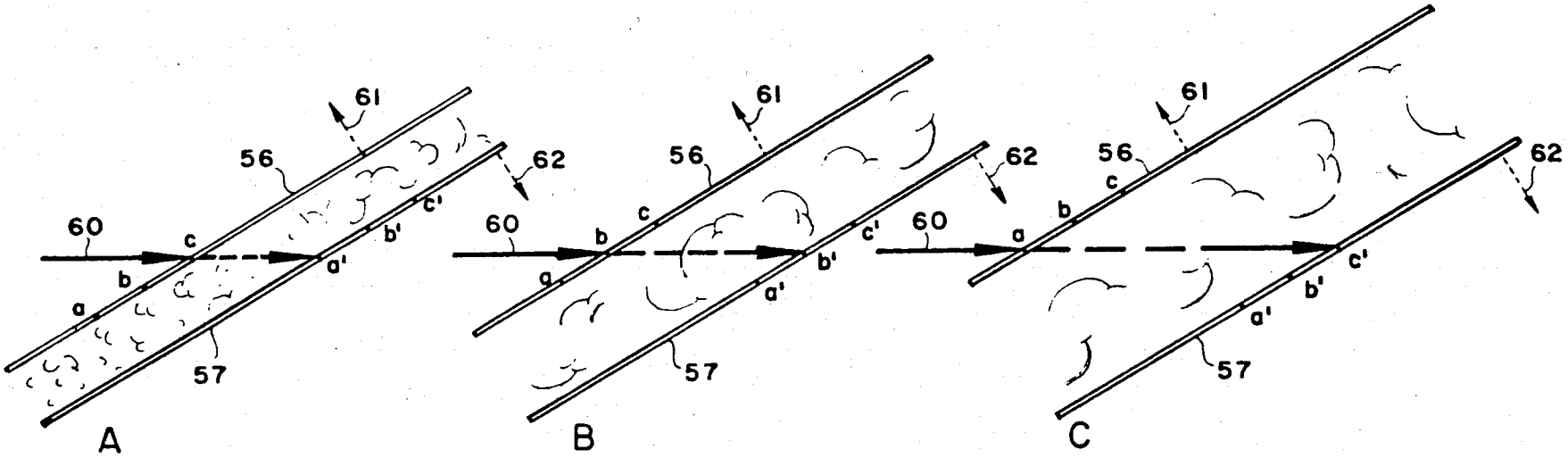
FIG. 11 is a diagrammatic illustration of the functioning of the insert in an element according to the invention.

In consequence of such movements of plates 56 and 57 the thorn is de-energized and these occurrences are diagrammatically shown in FIG. 11 with reference to three operational phases A, B and C. In that figure the thorn is symbolized by the arrow 60 and arrows 61 and 62 show the direction in which plates 56 and 57 move upon detonation of explosive layer 55. The letters a, b, c and a', b', c', signify imaginary reference points on the surface of plates 56 and 57.

In operational phase A, thorn 60 penetrates plate 56 at reference point c and impinges upon plate 57 at reference point a'. In operational phase B the distance between plates 56 and 57 has increased and accordingly the relative positions of plates 56 and 57 with respect to thorn 60 have changed. In consequence thorn 60 now penetrates plate 56 at reference point b and impinges upon plate 57 at reference point b'.

In operational phase C the distance between plates 56 and 57 has increased still further and the relative positions of plates 56 and 57 with respect to thorn 60 have again changed, the thorn now penetrating plate 56 at reference point a and impinging upon plate 57 at reference point c'.

It is seen from the above that in consequence of the detonation of the explosive layer 55 and the resulting change of position of plates 56 and 57 with respect to thorn 60, the thorn continuously moves along both plates with the result that it is continuously faced by new, unimpaired surface portions of both plates. In consequence of all this the energy of the thorn is continuously dissipated so that when the thorn reaches the substrate, if it at all gets that far, it is so weakened that it is no longer in a position to pierce the substrate wall.

As plates 56 and 57 are driven away and towards the substrate respectively, they impinge on respectively the cover and base members of element 53. In many cases the impinging plate 56 will stamp out a portion of the cover member and progress further together with it with the result that the stamped out cover portion also contributes to the weakening of the thorn in the same manner as described above.

Moreover, where the base member is mounted clear of the substrate such as in FIG. 4 there occurs a similar effect and it is thus understood why in some cases it is desired that an element having a base plate should be mounted clear of the substrate.

We claim:

1. An element of an add-on reactive armour for protecting existing armour against shaped charge warheads, comprising a cover member having suspended and distanced therefrom on a side that faces the existing armour, at least one explosive insert comprising an explosive layer sandwiched between two metal layers, such that when the element is mounted on the existing armour, the explosive insert remains distanced therefrom, and further comprising a base member that is longitudinally skirted and comprises side walls extending to a level slightly above said cover member when fastened to the same, whereby said explosive insert is shielded from the surroundings and shock waves emanating from a detonating explosive insert of said element are prevented from spreading laterally.

2. An element according to claim 1, comprising at least two explosive inserts.

3. An element according to claim 2, comprising at least one partition member for separating two neighbouring explosive inserts.

4. An element according to claim 1 wherein each explosive insert is mounted substantially in parallel to the top portion of the cover member.

* * * * *